United States Patent [19]

Romanauskas

[11] 4,344,563

[45] Aug. 17, 1982

[54] CENTRIFUGE ROTOR HAVING VERTICALLY OFFSET TRUNNION PINS

[75] Inventor: William A. Romanauskas, Saulsbury, Conn.

[73] Assignee: E. I. Du Pont de Nemours and Company, Wilmington, Del.

[21] Appl. No.: 220,199

[22] Filed: Dec. 23, 1980

[51] Int. Cl.[3] ..... B04B 9/12

[52] U.S. Cl. ..... 233/26

[58] Field of Search ..... 233/26, 27, 28, 1 R, 233/1 C, 23 A

[56] References Cited

U.S. PATENT DOCUMENTS

| | | | |
|---|---|---|---|
| 3,028,075 | 4/1962 | Blum | 233/26 |
| 3,722,791 | 3/1973 | Wright | 233/26 |
| 3,762,635 | 10/1973 | Hankey | 233/26 |
| 4,009,824 | 3/1977 | Wright | 233/26 |
| 4,314,662 | 2/1982 | Uchida | 233/26 |

*Primary Examiner*—Robert W. Jenkins

[57] ABSTRACT

This invention relates to a centrifuge rotor of the swinging bucket type characterized in that the trunnion-receiving bores provided into the arms at the radial outward end thereof are arranged such that the axis of the bore provided into one surface of the arm lies above a horizontal plane through the arm and the axis of the bore provided on the other surface the arm lies below the arm and that the bores provided in confronting surfaces of adjacent arms lie on the same side of the horizontal plane.

10 Claims, 7 Drawing Figures

CENTRIFUGE ROTOR HAVING VERTICALLY OFFSET TRUNNION PINS

TECHNICAL FIELD

This invention relates to a swinging bucket rotor for a centrifuge and, in particular, to a rotor wherein the trunnion support pins for the buckets are disposed in each side of the radially outer ends of the arms of the rotor and are vertically offset.

BACKGROUND ART

Centrifuge rotors of the swinging bucket type are well known. These rotors are typified by a central hub portion having arms radiating outwardly therefrom. The radially outward ends of the arms are typically somewhat enlarged to define a support portion adapted to receive the trunnion support pins on which the buckets are carried. The lateral surfaces of the enlarged support portion extend substantially vertically or parallel to the axis of rotation of the rotor. The trunnion pins are received in bores extending into the enlarged support portion. The axes of the pins on confronting surfaces of angularly adjacent arms are co-planar and extend toward each other along a substantially chordal line. Onto confronting pairs of these trunnion pins are mounted the swinging buckets which receive a container carrying the sample to be centrifuged. Suitable trunnion pockets are provided at predetermined locations on the bucket to effectuate the mounting of the bucket to the rotor. When the rotor is at rest the buckets depend vertically downwardly from the trunnion pin so that the axis of the bucket is substantially parallel to the rotational axis of the rotor. As the rotor is brought up to operating speed, however, the buckets pivot about the trunnion pins and swing radially outwardly under the influence of a centrifugal force field. That is, during operation the axis of the bucket is substantially perpendicular to the rotational axis of the rotor.

It is important that the support portions at the outward ends of each of the arms have a sufficient volume of material to adequately support the trunnion-receiving bores which extend thereinto from each lateral surface. With relatively large diameter rotors, or with smaller diameter rotors having a bucket-carrying capacity of four buckets or less, sufficient material is usually present in the support portions at the radially outer ends of each of the arms. Thus, providing trunnion-receiving bores into each lateral side of the support portion so that a sufficient volume of material remains to adequately support the trunnion pins may be relatively easily accomplished.

However, with small rotors and/or rotors having a capacity of greater than four buckets it is often difficult to arrange and locate the trunnion-receiving bores such that a sufficient volume of material remains in the support portion to adequately bear against the trunnion pins. If the trunnion-receiving bores on opposite sides of a rotor arm communicate with each other, the integrity of the support portion of the arm may be compromised.

One expedient for locating trunnion pins in small diameter and/or large capacity rotors is disclosed in U.S. Pat. No. 4,009,824, issued to Wright. This patent discloses a centrifuge rotor in which a single bore is formed in the radially outer support portion on each of the arms, the bore extending perpendicularly to the radial axis of the arm. A trunnion pin is received in each of the bores, each trunnion pin including an elongated central portion and having acutely oriented opposite extremities. When the trunnion pin is inserted into the bore the opposite extremities of each trunnion pin extending outwardly from the lateral surfaces of the arm coaxially towards the outwardly extending extremity of the pin disposed in an angularly adjacent arm to thereby form a pair of trunnion pins for receiving the bucket assembly.

DISCLOSURE OF THE INVENTION

This invention relates to a swinging bucket centrifuge rotor having a small diameter and/or a bucket capacity in excess of four bucket assemblies wherein the rotor may receive trunnion pins on each lateral side of each rotor arm thereof without adversely impacting upon the support capability of each rotor arm. The rotor is of the type having a central hub portion from which a plurality n of arms radiate outwardly. The ends of each the arms lie on the substantially circular perimeter of the rotor, the arms subdividing the circular perimeter of the rotor into n segments. Each arm terminates in a trunnion support portion. Each trunnion support portion has a first and a second substantially vertically extending lateral surface on opposite sides thereof. A trunnion-receiving bore is provided into the support portion from each surface such that the axis of each of the bores is substantially perpendicular to the surface into which it is extends. The rotor is characterized in that the axis of the bore extending into the support portion from one surface of each arm lies above a substantially horizontal reference plane extending through the rotor while the axis of the bore extending into the support portion from the opposite surface of each arm lies below the horizontal plane. The horizontal plane is substantially perpendicular to the axis of rotation of the rotor and subdivides each of the arms into upper and lower horizontal portions. The bores on confronting surfaces of adjacent arms are each substantially coaxial and disposed on opposite ends of a chordal line lying across each segment of the rotor. In the preferred embodiment the bores are disposed completely above or below the horizontal plane. The bores are each adapted to receive a trunnion support pin.

When a rotor is provided with n number of arms such that n/2 is odd, the trunnion pins received into the bores on confronting faces of the arms which define diametrically opposed segments of the rotor lie on opposite sides (i.e., above or below) of the horizontal plane. That is, when n/2 is odd, if the pins at each end of the chord in one segment lie above the plane, then the pins at each end of the chord in the diametrically opposed segment lie below the plane. However, when n/2 is even, the pins extending into the bores provided in confronting surfaces of the arms which define diametrically opposed segments of the rotor lie on the same side (i.e., above or below) of the horizontal plane. Thus, when n/2 is even, if the pins at each end of the chord in one segment lie above (or below) the plane, then the pins at each end of the chord in the diametrically opposed segment are likewise above (or below) the plane.

BRIEF DESCRIPTION OF THE DRAWINGS

The invention will be more fully understood from the following detailed description thereof taken in connection with the accompanying drawings, which form a part of this application, and in which.

DETAILED DESCRIPTION OF THE INVENTION

Figure 1:
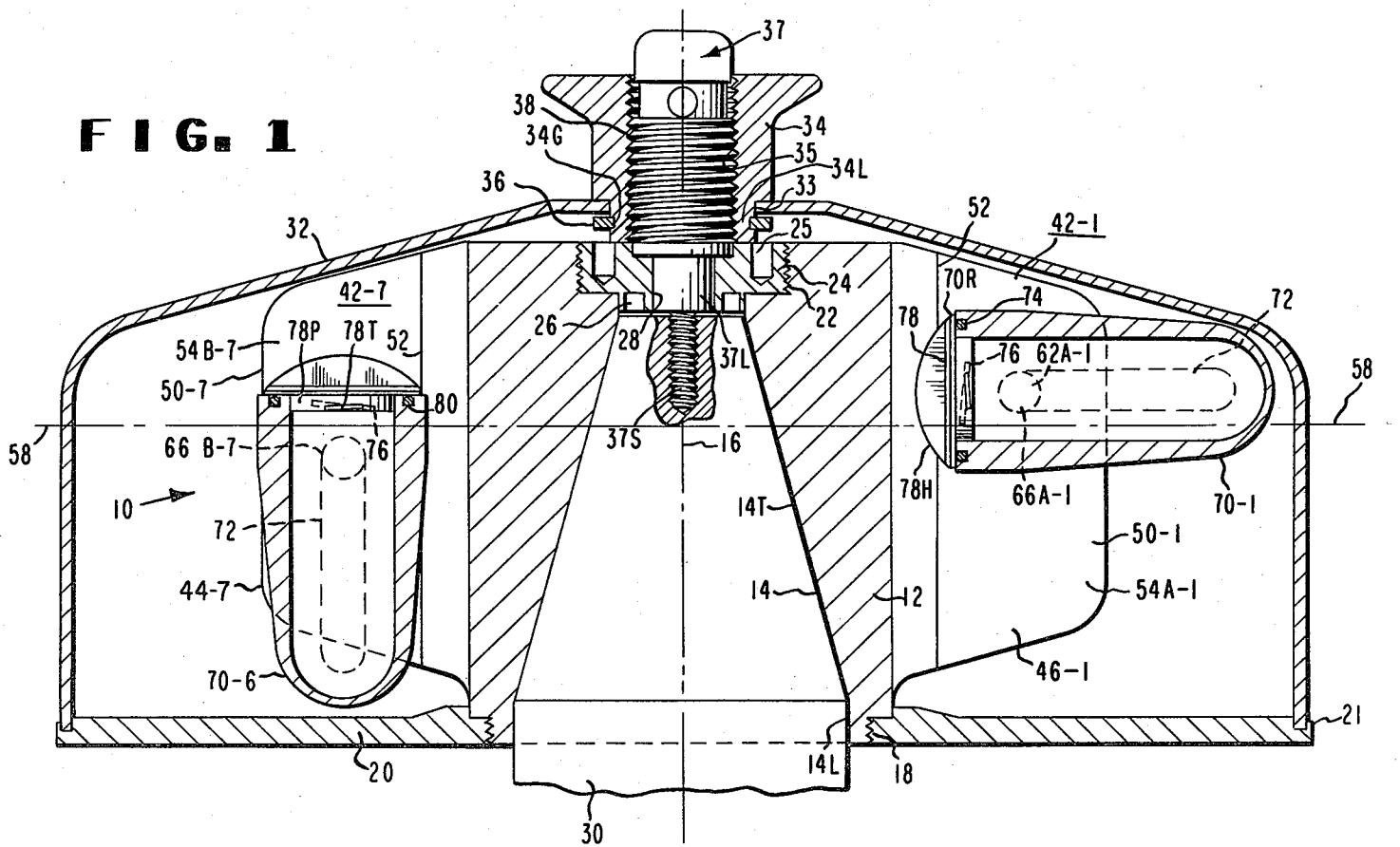
FIG. 1 is a side elevational view entirely in section illustrating a centrifuge having a rotor in accordance with the instant invention and having a cover disposed thereover.

Throughout the following detailed description similar reference numerals refer to similar elements in all figures of the drawings.

With reference to FIG. 1, shown is a centrifuge having a rotor generally indicated by reference numeral 10 in accordance with the instant invention. The rotor 10 includes a central hub portion 12 having a central axial bore 14 extending therethrough. The major portion of the bore 14 is tapered, as at 14T, and inclines with respect to the axis of rotation 16 of the rotor 10. The lower portion 14L of the bore 14 is coaxial with the axis of rotation 16 of the rotor 10. The exterior surface of the lower portion of the hub 12 is notched, as at 18. An annular base plate 20 is suitably connected as by threading about the notched lower periphery of the hub 12 substantially coaxially with the axis 16. The base plate 20 provided with a lip 21 about the periphery.

A threaded counterbore 22 communicates with the upper end of the tapered portion 14T of the hub bore 14. An adapter 24 is threadedly secured into the counterbore 22 of the hub 12. Spanner holes 25 assist in securing the adapter 22 to the hub 12. The lower surface of the adapter 24 has a groove 26 which is coaxial with a bore 28 provided through the adapter 22 for a purpose made clear herein. The bore 14 receives an upwardly projecting shaft 30 by which the hub 12 is connected to a source of motive energy for rotating the rotor 10 about the axis 16. Pins (not shown) project downwardly from the adapter 24 and engage corresponding pins (not shown) extending upwardly from the shaft 30 on the same bolt circle and on the center of the groove 26 such that when these pairs of pins abut sidewise torque is transmitted from the shaft 30 to the rotor 10.

The rotor 10 may be entirely surrounded by a domed cover 32. The cover 32 has an opening 33 coaxial with the axis 16 of the rotor. The lower edge of the cover 32 is received in the lip 21 of the base plate 20. An annular dome handle 34 has a projecting lug portion 34L which extends through the opening 33 in the cover 32. The lug portion 34L has a circumferential groove 34G therein. The handle 34 is provided with internal threads 35. A snap ring 36 is received in the groove 34G in the lug 34L to secure the handle 34 to the cover 32. A locking shaft 37 having external threads 38 thereon and a projecting portion 37L is insertable through the registered openings in the handle 34 and the adapter 24. A threaded stud 37S extends from the shaft 37. The rotor 10 is secured to the shaft 30 by the stud 37S. The engagement of the threads 35 and 38 secures the cover 32 to the rotor 10. When secured, the lower projecting portion 37L of the shaft 37 is received within the bore 28 in the adapter 24.

Figure 2:
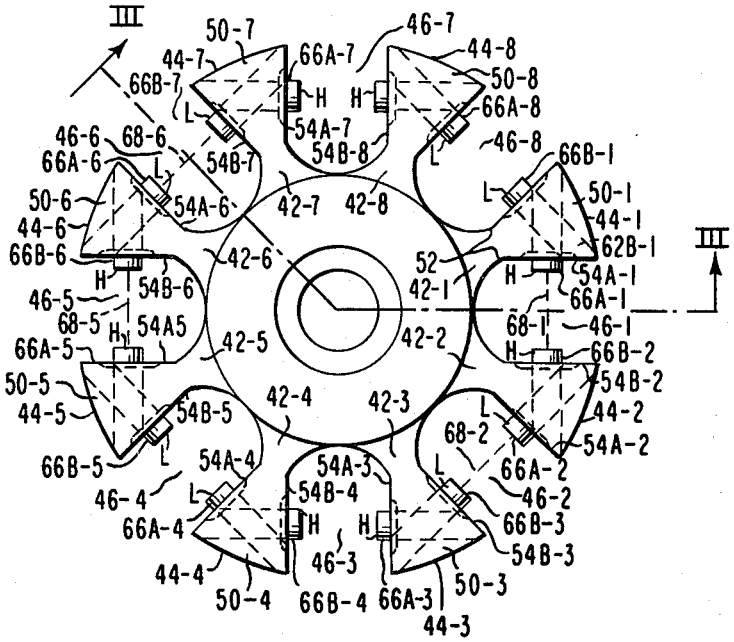
FIG. 2 is a plan view in a reduced scale of the rotor shown in FIG. 1.

A plurality n of arms 42 radiate outwardly from the hub portion 12. In FIGS. 1 and 2, the number of arms n is shown to equal eight, with the individual arms being indicated by reference characters 42-1, 42-2, . . . 42-8. As seen in FIG. 2, the radially outermost tips 44 of each of the arms 42 lie on the substantially circular perimeter of the rotor 10. The rotor is arranged such that confronting lateral surfaces of angularly adjacent pairs of the n arms 42 cooperate to define n segments 46 of the circular plan of the rotor 10. Thus, in FIG. 2, for example, confronting sides of the angularly adjacent arms 42-1 and 42-2 cooperate to define the segment 46-1. The confronting sides of the angularly adjacent arms 42-2 and 42-3 cooperate to define the segment 46-2. The pattern continues clockwise about the rotor 10 in a similar manner, with the confronting sides of the arms 42-8 and 42-1 cooperating to define the segment 46-8. The radially outer portion of each of the arms of 42 defines an enlarged trunnion support portion 50 which bends, as at 52 (FIGS. 1 and 2), from the remainder of the arm 42 toward the next-angularly adjacent arm. Each side of the enlarged support portions 50 is provided substantially vertically extending surfaces 54A and 54B. For definitional purposes a reference plane 58 (FIGS. 1, 3 and 4) extends through the rotor 10 substantially perpendicular to the axis of rotation 16 of the rotor. The plane 58 subdivides each of the arms 42 into an upper and lower horizontal portion for a purpose made clear herein.

Each of the support surfaces 54A and 54B at the radially outward end of each of the rotor arms 42 is provided with a trunnion-receiving bore 62. The bores 62 extend completely through the trunnion support portions 50. The surface 54 from which the bore originates is provided with a rectangular depression 64 (for example, FIGS. 3 and 4) surrounding the lip of the opening 62 for a purpose to be disclosed herein.

Figure 3:
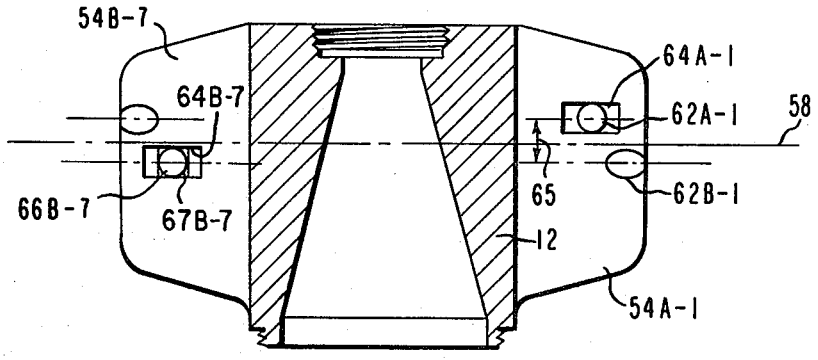
FIG. 3 is a view of the rotor taken along view lines III—III in FIG. 2.

The bores 62 extend into the surfaces 54 such that the axis of the bore 62A on the first surface 54A of an arm 42 and the bore axis of the 62B extending into the second surface 54B of that same arm 42 lie either above or below the reference plane 58. In the preferred embodiment of the invention the bores lie completely either above or below the reference plane. With reference to FIG. 3, for example, the trunnion-receiving bore 62A-1 extending into the surface 54A-1 of the arm 42-1 lies completely above the reference plane 58 while the trunnion-receiving bore 62B-1 extending into the surface 54B-1 lies completely below the reference plane 58. As seen in FIG. 3, the axes of the bores 62A-1 and 62B-1 are vertically offset by a distance 65.

Figure 4:
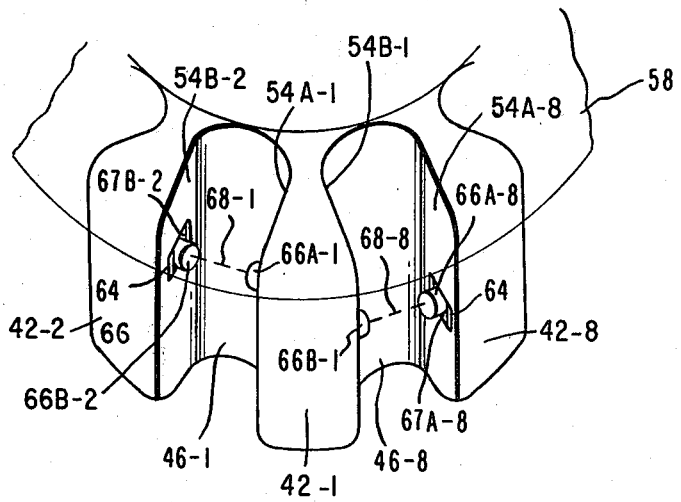
FIG. 4 is an enlarged perspective view of adjacent arms of a rotor in accordance with the instant invention showing the relationship of trunnion-receiving bores and trunnion pins in confronting surfaces of adjacent arms.

Trunnion pins 66 are inserted into each of the trunnion-receiving bores 62 as exemplified by the pin 66B-7 (FIG. 3). The pins have rectangular flanges 67 which are received within the depressions 64 surrounding the lips of the openings 62. The axis of each pin 66 is coincident with the axis of its associated bore 62. Further, the bores 62 are arranged such that when the pins 66 are received therein the axes of the pins are coincident and lie along the chordal line 68 of each segment 46 (FIGS. 2 and 4).

Figure 5:
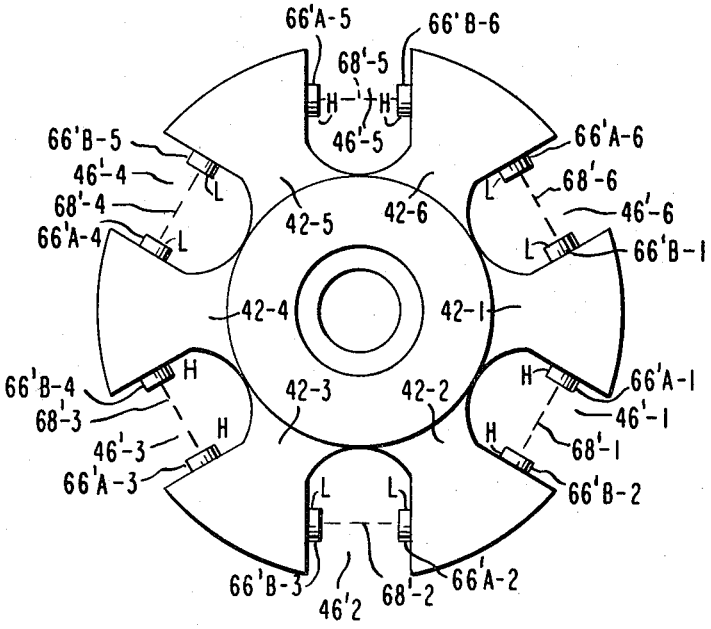
FIGS. 5, 6 and 7 illustrate alternate embodiments of the invention where the number of arms radiating from the rotor are respectively six, ten and twelve.

In addition, as seen in FIG. 5, the bores 62 are arranged such that the trunnion pin 66 inserted into a surface 54 of a given arm and the trunnion pin 66 inserted into the confronting surface 54 of the next-angularly adjacent arm are correspondingly disposed above or below the reference plane 58. Thus, with reference to FIG. 4 for example, it is seen that the trunnion pin 66B-2 extending into the surface 54B-2 lies above the reference plane 58. Similarly, the pin 66A-1 extending into the surface 54A-1 also lies above the reference plane 58 to correspond to the pin 66B-2. The trunnion pin 66B-1 provided on the surface 54B-1 lies below the reference plane 58. Similarly, the trunnion pin 66A-8 extending into the surface 54A-8. lies below the reference plane 58 to correspond to the pin 66A-8.

With reference again to FIG. 2, wherein the plurality of arms numbers eight (n equals 8) it is to be noted that within the diametrically opposite segments 46 the confronting trunnion pins 66 lying at each end of the chordal line 68 in those segments 46 are on similar sides of the horizontal reference plane 58. Thus, for example, the pins 66 lying on the chordal lines 68-1 and 68-5 in the diametrically opposed segments 46-1 and 46-5, respectively, all lie above the reference plane 58. (The pins 66 lying above the reference plane 58 in FIG. 2 are indicated by a reference character H). The pins 66 lying on the chordal lines 68-2 and 68-6 in the diametrically opposed segments 46-2 and 46-6, respectively, lie below the reference plane 58. (The pins 66 lying below the reference plane 58 in FIG. 2 are indicated by a reference character L.)

With reference to FIG. 5, where six arms 42 radiate outwardly from the hub, it is noted that the trunnion pins 66' lying at the ends of the chordal lines 68 are disposed on opposite sides of the horizontal plane 58. For example, the pins 66' lying on the chordal line 68'-1 in the segment 46'-1 of the rotor 10' shown in FIG. 4 both lie above the reference plane 58, while the pins 66' lying on the chordal line 68'-4 in the diametrically opposed segment 46'-2 both lie below the reference plane 58. In FIG. 5, pins 66' lying above the reference plane 58 are indicated by a reference character H, while pins lying below the plane 58 are indicated by the reference character L.

From the foregoing it may be observed that where a rotor has a number of arms n such that n/2 is an even number, a situation similar to that depicted in FIG. 2 occurs, viz., the pins at the ends of the chords in diammetrically opposed segments lie on the same side (either above or below) of the reference plane. Conversely, when a rotor contains n arms such that n/2 is an odd number, the situation depicted in FIG. 5 occurs, viz., the pins at the ends of the chordal lines in diammetrically opposed segments lie on opposite sides (above or below) of the reference plane.

In operation, if the quotient of n/2 is an even number, then such a rotor may be utilized with any even number of buckets and if each pair of buckets is disposed in a diammetrically opposite segment the rotor will be in balance during operation. However, if the quotient of n/2 is an odd number, then such a rotor is balanced in operation only if the number of buckets is a whole number multiple of that quotient and if the buckets are placed in segments wherein all pins lie on the same side of the plane.

Figure 6:
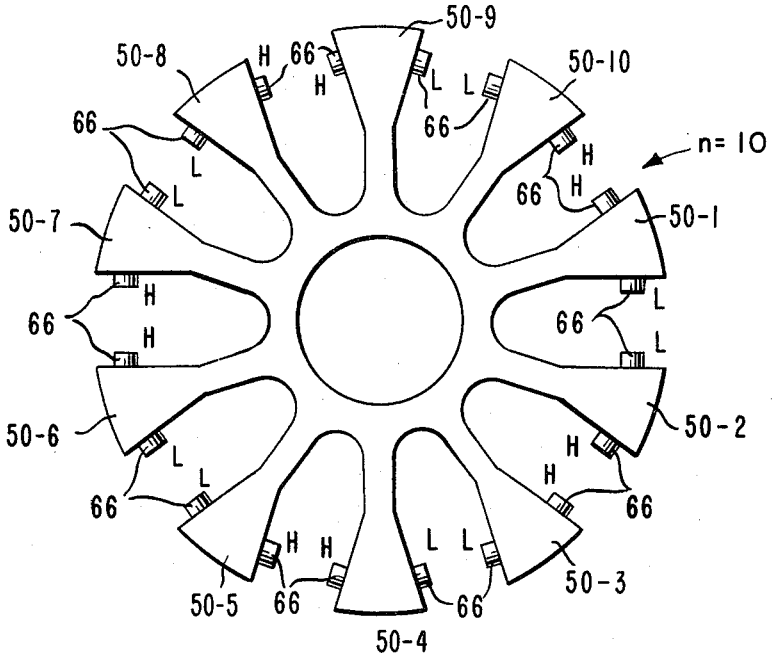
Figure 7:
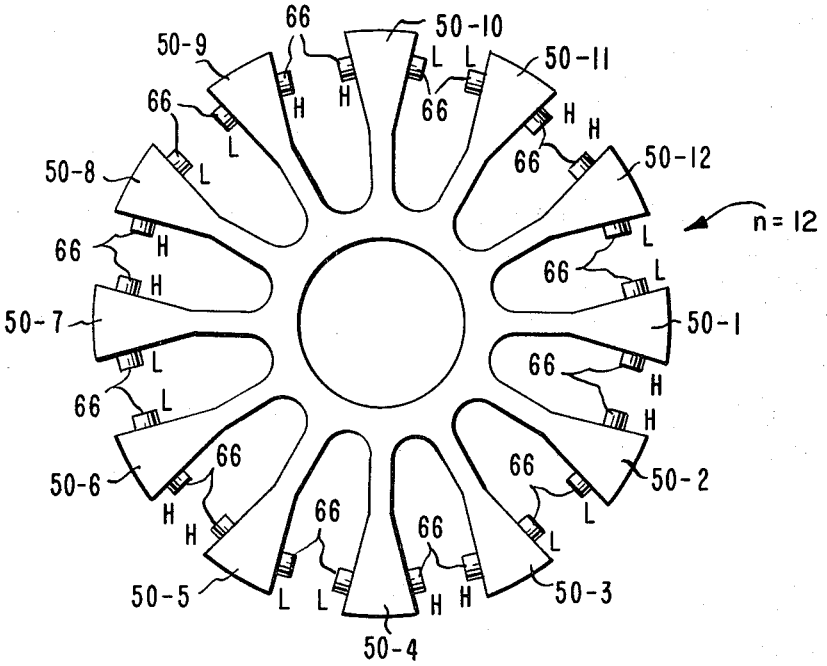

FIGS. 6 and 7, which respectively disclose a rotor having ten and twelve radiating arms respectively, confirm the above generalizations. In FIGS. 6 and 7, the symbols H and L, respectively, are again used to indicate that a bore and pin lie above or below the reference plane. In FIG. 6, when n equals ten and n/2 is an odd number (equal to five) a situation similar to that discussed in connection with FIG. 5 occurs. That is the pins on the chords in opposed segments lie on opposite sides of the plane 58 and the rotor is balanced in operation only if the number of buckets used is a whole number multiple of the quotient (i.e., five or ten). In FIG. 7, where n equals twelve such that n/2 is an even number a situation similar to that discussed in connection with FIG. 2 exists. That is, the pins on the chords of opposed segments lie on the same side of the plane 58 and the rotor is balanced if any even number (two, four, six, eight, ten, or twelve) of buckets are used, with any pair of buckets being disposed in diametrically opposed segments.

With reference again to FIG. 1, buckets 70 may be provided with pockets 72. The pockets 72 (located diametrically with respect to the bucket 70) receive confronting trunnion pins 66 and are thereby supported from the rotor 10. The pins 66, when inserted into the bores provided on confronting surfaces of angularly adjacent arms, lie coaxially in a plane parallel to the reference plane, and either above or below the reference plane, as discussed above. When not in operation, the buckets depend vertically from the pins (as at 70-6 in FIG. 1). When at speed, the bucket 70-1 pivots and extends horizontally within the cover 32. The rim portion 70R of each of the buckets is provided with an annular groove 74. Additionally, a pair of helical grooves 76 (one of which is visible in FIG. 1) are provided on the internal surface of the bucket 70 in the vicinity of the rim thereof.

A cover 78 is provided for each of the buckets 70. The cover 78 is provided with a handle portion 78H. Depending from the underside of the cover 78 is a plug 78P. Tangs 78T (one of which is shown in FIG. 1) are provided on the plug 78P. The tangs 78T are engageable with the grooves 76 disposed on the internal surface of the buckets 70 to thereby secure the cover 78 thereto. An O-ring or other suitable seal 80 is received within the annular groove 74 to seal the interface between the cover 78 and the bucket 70. Through the provision of the cover 78 thermal gradients and aerosoling of the sample being centrifuged are prevented.

Those skilled in the art, having benefit of the teachings hereinabove set forth will undoubtedly realize that numerous modifications thereto may be effected. It is to be understood, however, that such modifications lie within the contemplation of this invention as defined in the appended claims.

What is claimed is:

1. In a centrifuge rotor of the type having a hub from which a plurality of arms radiate outwardly, each arm having a first and a second vertically-extending surface on opposite sides thereof and a trunnion-receiving bore extending into the arm from each surface, characterized in that the axis of the bore extending into the arm from the first surface lies above a horizontal plane extending through the arm while the axis of the bore extending into the arm from the second surface lies below the horizontal plane and that the bores on confronting surfaces of angularly adjacent arms each lie on the same side of the horizontal plane.

2. The centrifuge rotor of claim 1 wherein there are n arms radiating from the hub to subdivide the rotor into n number of segments such that when n/2 is odd, the bores in confronting surfaces of angularly adjacent arms which define one segment and the bores in confronting surfaces of angularly adjacent arms which define the diammetrically opposed segment lie on opposite sides of the horizontal plane.

3. The centrifuge rotor of claim 1 wherein there are n arms define radiating from the hub to subdivide the rotor into n number of segments such that when n/2 is even, the bores on confronting surfaces of the angularly adjacent arms which define diametrically opposite segments are all on the same side of the horizontal plane.

4. The centrifuge rotor of claims 1, 2 or 3 wherein the bore extending into the arm from the first surface and the bore extending into the arm from the second surface each respectively are completely above and below the horizontal plane.

5. A centrifuge comprising:

a rotating member having a hub from which a plurality of arms radiate, each arm terminating in a trunnion support portion having a lateral surface on opposite sides thereof, a trunnion-receiving bore extending into the support portion from each surface, the axis of the bore extending into the arm from one surface lying above a horizontal reference plane extending through the arm while the axis of the bore extending into the arm from the other surface lying below the horizontal reference plane, the bores on confronting surfaces of angularly adjacent arms each lying on the same side of the horizontal reference plane;

a first and a second trunnion pin disposed within the bores on confronting surfaces of angularly adjacent arms, the pins being coaxially disposed in a plane parallel to the horizontal reference plane; and, a bucket pivotally mountable in a supported relationship between the first and second trunnion pins.

6. The centrifuge of claim 5 wherein the rotating member has n arms defining n segments such that when n/2 is odd the bores on the confronting surfaces of angularly adjacent arms which define one segment and the bores in the confronting surfaces of angularly adjacent arms which define the diammetrically opposed segment lie on opposite sides of the horizontal reference plane.

7. The centrifuge of claim 5 wherein the rotating member has n arms defining n segments such that when n/2 is even the bores on the confronting surfaces of the angularly adjacent arms which define diammetrically opposite segments are all on the same side of the horizontal plane.

8. The centrifuge of claims 5, 6 or 7 wherein the bore extending into the arm from the first surface and the bore extending into the arm from the second surface each respectively lies completely above the horizontal plane.

9. The centrifuge of claims 5, 6 or 7 further comprising a cover engageable with the bucket.

10. The centrifuge of claim 8 further comprising a cover engageable with the bucket.

* * * * *